United States Patent [19]

McInnes

[11] Patent Number: 5,070,942

[45] Date of Patent: Dec. 10, 1991

[54] WELL TUBING HANGER SEALING ASSEMBLY

[75] Inventor: Robert McInnes, Shawland, Scotland

[73] Assignee: Cooper Industries, Inc., Houston, Tex.

[21] Appl. No.: 577,666

[22] Filed: Sep. 5, 1990

[51] Int. Cl.[5] ..... E21B 33/04

[52] U.S. Cl. ..... 166/115; 166/182; 166/208; 285/139; 285/142

[58] Field of Search ..... 166/115, 182, 208; 285/139-143

[56] References Cited

U.S. PATENT DOCUMENTS

| | | | |
|---|---|---|---|
| 4,548,273 | 10/1985 | Leicht et al. | 285/912 X |
| 4,674,576 | 6/1987 | Goris et al. | 166/182 X |
| 4,691,780 | 9/1987 | Galle, Jr. et al. | 166/208 X |
| 4,757,860 | 7/1988 | Reimert | 166/208 |
| 4,949,786 | 8/1990 | Eckert et al. | 166/208 |

*Primary Examiner*—Hoang C. Dang

*Attorney, Agent, or Firm*—Eddie E. Scott; William B. Patterson; Alan R. Thiele

[57] ABSTRACT

The tubing hanger seal assembly of the present invention includes a metal to metal seal that is energized from above by a drive sleeve. The drive sleeve is threaded to the outside of the tubing hanger and as it is rotated downward, engages a load ring which in turn energizes the metal to metal seal by compressing it between the tubing hanger and tubing head. In addition, the invention includes a split ring which is forced into a notch by the drive sleeve in the inside of the tubing head to prevent the seal from being blown-out by upward pressure.

3 Claims, 2 Drawing Sheets

WELL TUBING HANGER SEALING ASSEMBLY

BACKGROUND OF THE INVENTION

This invention relates to tubing hanger seals; more particularly this invention relates to tubing hanger seals that utilize a drive sleeve to compress a metal to metal seal between the inside of a tubing head and the outside of a tubing hanger.

In oil field or natural gas production operations it is always essential to seal the annulus between the production tubing and the well casing. In high temperature environments, metal seal rings have been used in place of elastomeric or plastic seals. In most cases, the tubing string provided the weight to compress the metal seal between the hanger and the tubing head shoulder. The result was that seal integrity was determined by an ever changing tubing string weight and annular formation pressure against the projected surface area of the bottom of the hanger. In addition, the seal was uni-directional and offered little protection against a blowout situation.

It is therefore an object of this invention to provide a metal to metal tubing hanger seal that does not depend on the weight of the tubing string for its integrity.

It is a further object of this invention to provide a metal to metal seal that can be energized to a given load unaffected by the tubing string.

It is yet a further object of this invention to provide a metal to metal seal that will retain its integrity against upward as well as downward forces.

SUMMARY OF THE INVENTION

The present invention has, as its primary objective, the provision of a metal to metal tubing hanger sealing assembly which does not depend on the weight of the tubing string. The invention comprises a metal sealing ring energized through a threaded drive sleeve. The drive sleeve is threaded to the outside of the tubing hanger and is energized by a removable running tool. The running tool is attached to the sleeve and causes the threaded sleeve to travel down the outside of the hanger. As the sleeve moves down the hanger, it engages a split ring which it forces down and out into a groove in the inside of the tubing head. As the sleeve moves past the split ring, it engages a load transfer ring which in turn, energizes the metal sealing ring by compressing it between the tubing head and the frustroconical profile of the tubing hanger. Once the seal is energized to a predetermined load, the running tool is removed and the drive sleeve holds the metal to metal seal in place at the set force while the split ring serves to prevent any vertical movement of the hanger and seal ring.

BRIEF DESCRIPTION OF THE FIGURES

In the accompanying drawings which form part of the specification and are to be read in conjunction therewith.

DESCRIPTION OF A PREFERRED EMBODIMENT

Figure 1:
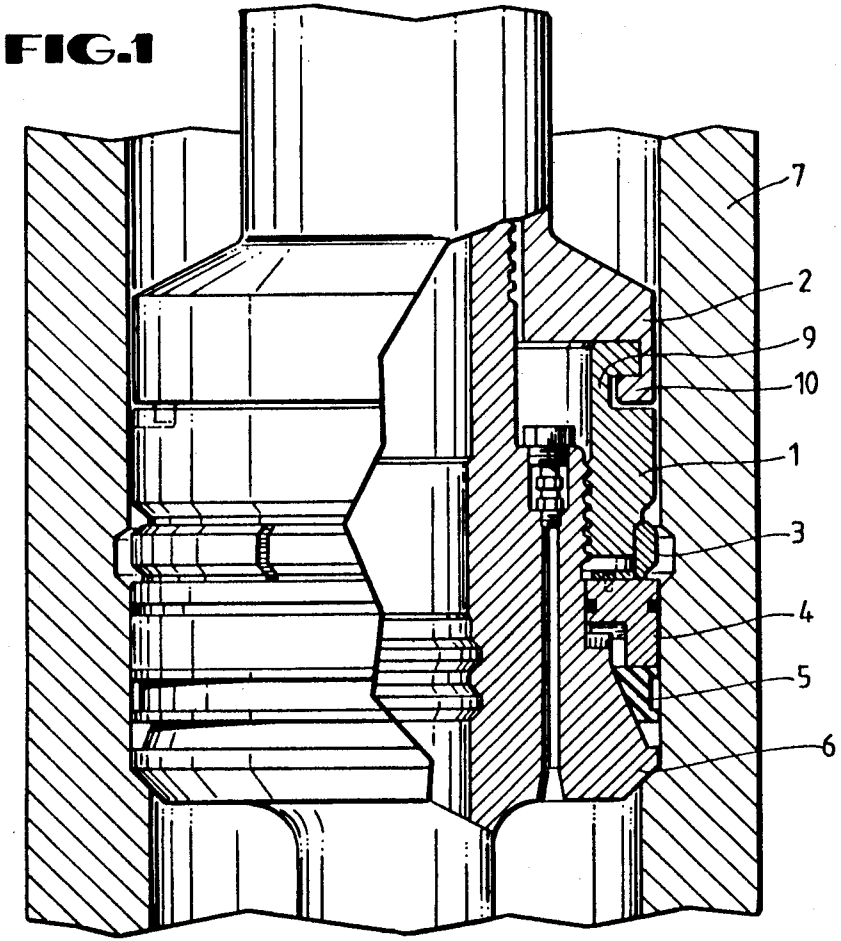
FIG. 1 is an elevation view, partly in section, of a wellhead component including a running tool, drive sleeve, split ring, load ring and metal sealing ring.

The sealing assembly of the present invention is utilized in a wellhead or tubing head having a flange at the upper and lower ends and holding a tubing hanger in its interior. The outside of the tubing hanger is threaded. Referring to the drawings in greater detail, FIG. 1 shows a tubing head in partial section that utilizes a sealing assembly that is the subject of the present invention. The drive sleeve (1) fits between the inner wall of the tubing head (7) and the outside of the tubing hanger (6) and is threaded to the tubing hanger. The drive sleeve is energized or threaded by a removable landing tool (2) which is inserted and removed from above and utilizes a locking mechanism consisting of a mating J-slot (9) in the top of the drive sleeve and a J-pin (10) at the end of the landing tool (2).

Figure 2:
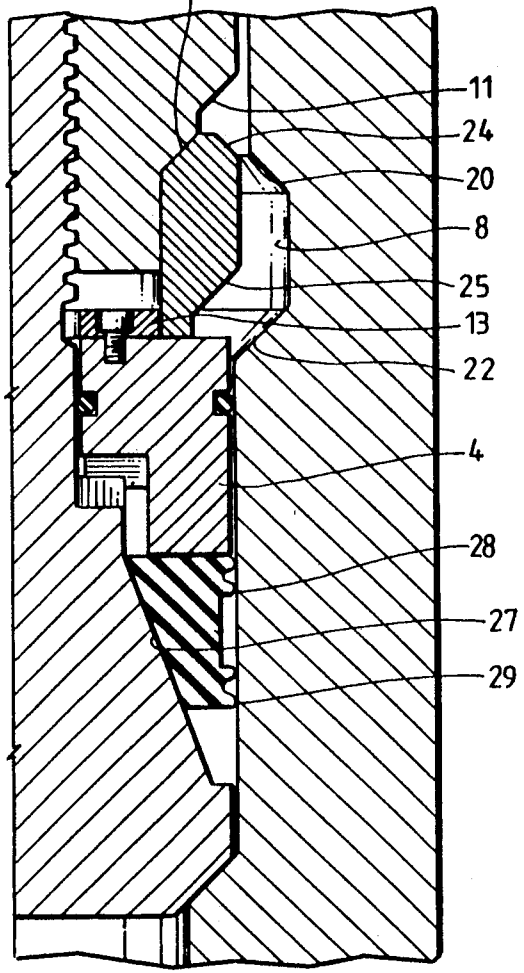
FIG. 2 is an elevation view in section showing the elements of FIG. 1 in greater detail.
Figure 4:
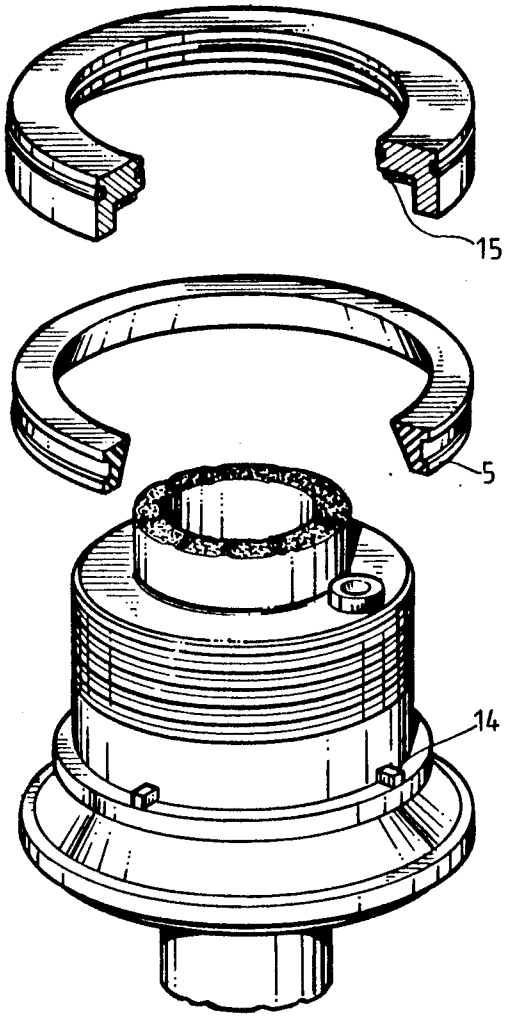
FIG. 4 is an exploded pictorial view showing the load ring, the metal sealing ring and the tubing hanger.
Figure 3:
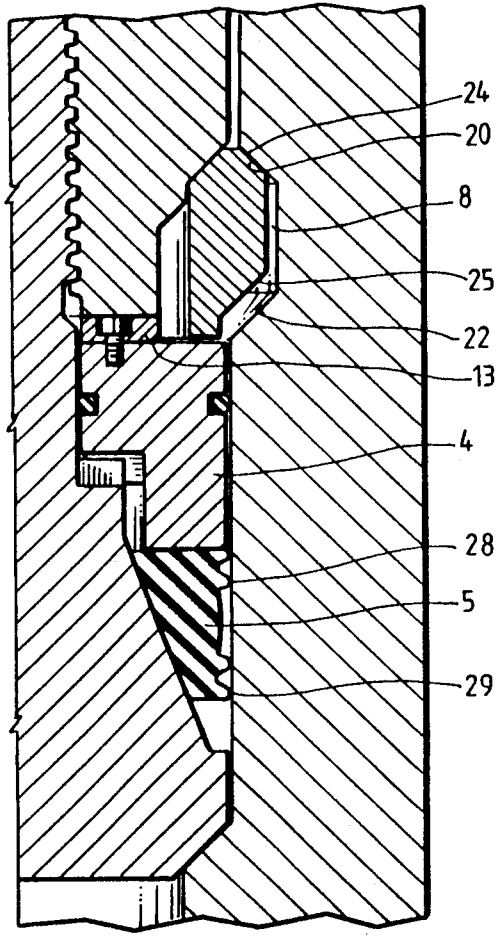
FIG. 3 is an elevation view of the elements of FIG. 1 depicting the sealing assembly in an energized state.

The drive sleeve (1) includes two inwardly sloping shoulders (11), (12) between its upper and lower diameters. As the sleeve moves down, the lower shoulder (12) contacts the split ring (3) forcing it down against the load ring (4) and then out into a groove (8) in the tubing head. Groove (8) includes a downwardly and inwardly facing shoulder (20) and an upwardly and inwardly facing shoulder (22). As the split ring moves into the groove, it is retained on the outside diameter between shoulders 11 and 12. This allows the sleeve to move down and energize the load ring (4) through a bearing (13). As shown in FIG. 2, the outside of split ring 3 includes an upwardly and outwardly facing shoulder (24) and a downwardly and outwardly facing lower shoulder (25). Rotation of the load ring is prevented by slots (15) on the load ring shown in FIG. 4 and mating knobs (14) on the outside of the tubing hanger also shown on FIG. 4. The load ring in turn, energizes the metal seal ring (5) by forcing it into a wedge shaped area formed between the outwardly sloped tubing hanger and the inside of the tubing head. The metal seal ring is itself wedge-shaped having a downwardly facing shoulder (27) at its interior and upper (28) and lower (29) sealing surfaces at its outer surface.

By applying a given amount of torque to the landing tool, a very precise amount of sealing pressure can be applied to the metal seal ring. The upper shoulder (11) prevents overloading of the seal. When the desired amount of torque has been applied, the running tool is removed and the metal sealing assembly remains energized by the drive sleeve. In addition, the split ring remains in the groove (8), preventing blowout.

Although the foregoing specifically describes one embodiment of the invention, it should be that the invention is not limited to a single embodiment and the inventive concepts could be utilized in a number of different ways.

As the foregoing demonstrates, the present invention overcomes the problems associated with relying on the weight of a tubing string to energize a metal to metal seal. In addition, the invention provides an effective way to guard against an upward surge of pressure from the well and the resulting blowout.

I claim:

1. A tubing hanger sealing system comprising:

a substantially cylindrical tubing head having a flange at each end, a substantially vertical longitudinal bore therethrough and a groove in the upper portion of the inside diameter of said substantially vertical longitudinal bore;

a substantially cylindrical tubing hanger with a longitudinal bore therethrough for communicating with a tubing string, said substantially cylindrical tubing hanger having a plurality of anti-rotational knobs on the exterior thereof;

a substantially cylindrical drive sleeve having threads on the lower inside portion thereof, said drive sleeve constructed and arranged to engage, in a threaded relationship, with said tubing hanger, said substantially cylindrical drive sleeve further having a larger upper outside diameter and a smaller lower, outside diameter, said outside diameters being separated by an inwardly slopping shoulder;

a substantially circular load ring having a smaller upper inside diameter and a larger lower inside diameter, said diameters separated by an inverted shoulder, said inverted shoulder having a plurality of slots on the underside thereof, said slots constructed and arranged to engage said anti-rotational knobs;

a metal sealing ring having an inner surface, said inner surface defining a downward facing shoulder and further defining an upper and lower outer sealing surface;

a split ring constructed and arranged to fit into said groove in the upper portion of said inside diameter of said tubing head, the outside diameter of said ring having an upper shoulder and a lower inverted shoulder corresponding to the shape of said groove;

a bearing ring attached to the top of said load ring to reduce friction between said substantially circular load ring and said drive sleeve.

2. The tubing hanger sealing assembly as defined in claim 1 wherein said cylindrical drive sleeve includes a J-slot around its upper perimeter, said J-slots constructed and arranged to allow engagement with a removable energizing tool.

3. The tubing hanger sealing assembly as defined in claim 1 wherein said cylindrical drive sleeve includes a larger upper diameter and a smaller lower diameter, said larger and smaller diameters being separated by two inwardly sloping shoulders.

* * * * *